United States Patent [19]

Hadden

[11] 4,439,242

[45] Mar. 27, 1984

[54] LOW HOT WATER VOLUME WAREWASHER

[75] Inventor: James P. Hadden, Tipp City, Ohio

[73] Assignee: Hobart Corporation, Troy, Ohio

[21] Appl. No.: 435,019

[22] Filed: Oct. 18, 1982

Related U.S. Application Data

[63] Continuation of Ser. No. 263,956, May 15, 1980, abandoned.

[51] Int. Cl.[3] ..... B08B 3/02

[52] U.S. Cl. ..... 134/25.2; 134/29; 134/30; 134/58 D

[58] Field of Search ..... 134/25.2, 26, 29, 30, 134/31, 58 D, 56 D, 57 D

[56] References Cited

U.S. PATENT DOCUMENTS

| | | | |
|---|---|---|---|
| 2,592,884 | 4/1952 | Fox et al. | 299/84 |
| 2,592,885 | 4/1952 | Fox et al. | 134/36 |
| 2,592,886 | 4/1952 | Fox et al. | 299/85 |
| 3,043,724 | 7/1962 | Balshaw | 134/25.2 |
| 3,044,092 | 7/1962 | Fox et al. | 15/75 |
| 3,049,133 | 8/1962 | Jacobs | 134/30 |
| 3,049,450 | 8/1962 | Koons et al. | 134/25.2 |
| 3,072,128 | 1/1963 | James | 134/30 |
| 3,146,718 | 9/1964 | Fox et al. | 103/38 |
| 3,370,597 | 2/1968 | Fox | 134/58 D |
| 3,378,933 | 4/1968 | Jenkins | 134/58 D |
| 3,704,170 | 11/1972 | Landwier | 134/25.2 |
| 3,903,909 | 9/1975 | Noren et al. | 134/58 D |

OTHER PUBLICATIONS

"Summary Report: Study of Commercial Multiple Tank Spray Type Dishwashing Machines", NSF Testing Labs, 1964.

R. A. Deininger, "Sanitizing Efficiency of Dishwashers: Alternative Temperature Settings", 1980.

*Primary Examiner*—S. Leon Bashore, Jr.

*Assistant Examiner*—K. M. Hastings

*Attorney, Agent, or Firm*—Biebel, French & Nauman

[57] ABSTRACT

A rack-type high capacity warewashing machine is designed to cleanse and sanitize foodware in a cycle time of the order of one minute and to accomplish sanitizing by heating the foodware with fresh hot water sufficiently to kill residual bacteria thereon. The method of operation of the machine includes a final rinse period in which fresh water at a temperature of at least 180° F. (82.22° C.) is sprayed over the foodware to remove residual soil and to heat the foodware surfaces to at least 160° F. (71.11° C.), followed by a dwell period in which the wet heated foodware is maintained in a substantially closed humid atmosphere to prolong the time during which the foodware surfaces remain above bacteria killing temperature and to cause a build-up of Heat Unit Equivalents to at least 3600.

4 Claims, 3 Drawing Figures

LOW HOT WATER VOLUME WAREWASHER

REFERENCE TO RELATED APPLICATION

This application is a continuation of application Ser. No. 263,956 filed May 15, 1981, abandoned.

BACKGROUND OF THE INVENTION

Warewasher machines fall into two generally distinct but somewhat overlapping categories, namely, commercial (restaurant, institutional or other public facility) warewashers and domestic (home) warewashers.

The cleaning efficacy and sanitization results of domestic warewashers are left to the manufacturers of such products. Most of such warewashers are designed to perform washing with an input water temperature of 140° F. This is the basic temperature at which domestic warewashing detergents are formulated to perform most effectively. The warewashers are filled with clean water and drained between three and six times for each wash cycle, depending on whether the load of dishes is lightly or heavily soiled. The operator may select any of the several different cycles he or she may wish to use. One or two of those fills will normally have detergent added to assist in stripping the soil from the dishes by means of a relatively high velocity rotating spray of pumped wash solution recirculated from a sump at the bottom of the warewasher. After washing, rinsing is accomplished by filling the sump with fresh water, recirculating it, draining the water, refilling the sump one or two additional times and repeating the rinsing operation. Such warewashers have relatively long time cycles (e.g. 50 to 70 minutes) and are used once a day on the average.

Because domestic warewashers are used by consumers primarily for their own families, the competitive marketplace provides the necessary incentive to manufacturers to design and build machines which do an effective job of washing and sanitizing.

Commercial warewashing is an entirely different matter. It involves highly productive machines which have fixed, short washing and rinsing cycles, measured in seconds rather than minutes. The end responsibility for washing dishes commercially is left to a businessman dealing with members of the public whose health may be at stake when using dishes washed under that businessman's control. Because of this, there came into existence in the late 1940's an organization called the National Sanitation Foundation (N.S.F.). One of its functions is to provide minimum standards to assure that dishware washed in commercial warewashers is in fact sanitized through bactericidal treatment considered by health authorities to be effective. This is achieved essentially in two different ways according to N.S.F. standards: (1) by high temperature machines which utilize a final rinse minimum time and volume and minimum temperature of 180° F. to assure thermal death of bacteria, or (2) by so-called low temperature machines which rinse with water at a minimum temperature of 120° F., inadequate to sanitize by itself, but which contains an effective germicidal chemical such as sodium hypochlorite (NaOCl). The chemical sanitizing additive must be proportioned in the rinse water at a minimum of 50 parts per million of available chlorine. Available chlorine can be defined as chlorine available to sanitize.

Any proportion less, or anything less than 180° F. final rinse water in a high temperature machine, is regarded by N.S.F. as not providing a proper safety margin for sanitization. In high temperature machines, N.S.F. has scientifically established a cumulative heat factor for a total or complete wash and rinse cycle. The heat factor is measured in "heat unit equivalents" (HUE, later defined) per second of time, which, cumulated, must reach a minimum total of 3600 HUE to be considered effective.

While N.S.F. standards are theoretically voluntary, public health and sanitation officials in the U.S. are believed to rely heavily on them. A manufacturer is permitted to place an N.S.F. label on the equipment to show that its design, manufacture and operation meet all of the minimum N.S.F. standards for that particular type of equipment. Many sanitation officials will not permit installation or use of commercial warewashers within their jurisdiction unless they have N.S.F. labels, indicating that they are "listed" as being recognized by N.S.F. In effect, N.S.F. standards are so well accepted that very few commercial warewashers are sold in the U.S. without N.S.F. listing.

In both the domestic and commercial warewasher field it has become fairly well recognized since the advent of the so-called "energy crisis" of the mid 1970's that an important way to reduce the cost and consumption of energy would be to decrease the volume of hot water used to wash dishes. For several years, domestic warewasher manufacturers have been working diligently to reduce water consumption to a minimum which would still provide satisfactory warewashing in terms of cleanliness in order to remain competitive. It can be said that, in the domestic warewasher field, it has been and continues to be conventional practice to seek to reduce energy consumption by decreasing the use of hot water.

Reducing energy consumption and cost in a commercial warewasher is quite another matter, particularly in view of the minimum standards established by N.S.F. A variety of different types of commercial units exists. In machines using the hot water sanitization principle, the N.S.F. standard minimum temperature is 180° F. for the final rinse water, as noted. In addition minimum water volumes are specified according to the size of dishrack handled by the machine. Since a minimum rinse temperature of 120° F. is acceptable in a chemical sanitizing low temperature machine, in terms of effective sanitization, the use of the sanitizer is equivalent to an energy saving of 60° F. reduction in the final rinse temperature. Offsetting the energy savings of chemical sanitizing machines, however, is an increase in the cost of chemicals and also the initial and servicing cost of equipment for dispensing the bleach and controlling water fill in the proper proportions for each warewasher cycle.

Faced with the problem of saving energy and its cost, and further faced with the 180° F. temperature and water volume requirements of high temperature machines, the primary industry solution in the past half dozen years or so has been to emphasize low temperature machines with chemical additives. Sales of low temperature machines have increased substantially in recent times, partially at the expense of sales of energy consuming high temperature machines. But such low temperature machines are not without fault, unfortunately. A prime disadvantage is that the lower temperature of the foodware items at the time of removal from the warewasher makes it considerably more difficult for them to air dry than when rinsed at 180°. Greater heat in the items from a hot water sanitizing machine tends to drive off remaining moisture much faster. In some instances the foodware from a low temperature machine may have to be reused immediately, while still partly wet. Ordinarily the items shouldn't be towelled, because of the potential of defeating the sanitization purpose. Many public health codes strictly forbid towel drying of dishes. In some restaurants, additional costly space and tabling in the kitchens have been provided to allow dishes washed in low temperature machines a greater period of time for drying. Nevertheless, many low temperature machines continue to be sold because of the reduction in energy costs as compared to presently existing high temperature machines. This is true even though some low temperature machines have greater overall annual operating costs due to greater use of expensive chemicals, water and time to wash items.

Chemical sanitizing low temperature warewashers have been known for many years. Originally they were intended for application where high temperatures were unacceptable, such as for a glass washer installed under a beverage bar. For general warewashing, however, they have been more widely used since the start of the energy crisis of the mid and late 1970's.

Earlier work on low temperature machines is exemplified by U.S. Pat. Nos. 2,592,884; 2,592,885; 2,592,886; 3,044,092; 3,146,718 and 3,370,597. These attempted to utilize the developed concepts of high temperature machines in conjunction with metering sodium hypochlorite directly into the fresh water lines used for final rinsing. While these machines performed satisfactorily for short periods of time, they were not really successful, particularly in hard water situations. Sodium hypochlorite tends to precipitate minerals, particularly calcium, magnesium and iron, from the fresh water at the point of introduction of the extremely small quantity of sodium hypochlorite metered into the water. This point in some instances was a tiny orifice in a venturi where the hypochlorite enters the fresh water line, and in others, it was the exit of a dosing system for hydraulically pumping the minute quantity of hypochlorite through a small orifice into the water line. Once such small orifices were affected by mineral build-up, metering became inaccurate or was cut off and required either replacement or frequent cleaning. It is doubted whether such systems using small orifices are in successful commercial existence in the U.S. today in low temperature warewashers.

At least as early as the 1940's, another form of chemical sanitizing low temperature warewasher became known, initially on a relatively small scale. It is referred to in the commercial warewasher trade as a "fill and dump" machine. It is of the general design and operation shown in U.S. Pat. No. 3,903,909.

In such machines the rinse water is recirculated through the same screen, pump, pipes and wash arms used by the dirty wash water, thus reducing cleanliness in the process. Injection of sanitizer directly into the sump of such warewashers is typically done by peristaltic or pressure pumps.

In addition to the fill and dump machines, several manufacturers (including the assignee of the present invention) have introduced a chemical sanitizing low temperature commercial warewasher which utilizes a fresh water rinse independent of the washing system, but mixes the fresh water and sodium hypochlorite in an auxiliary holding tank in their proper predetermined proportions prior to use by spraying through a rinse system dedicated solely to fresh rinse solution. This concept is shown in U.S. Pat. No. 4,147,558.

The assignee of this invention had a research program in progress some years ago to design a fill and dump machine of the type shown in aforementioned U.S. Pat. No. 3,903,909. The cleaning results observed in that program were deemed unsatisfactory, however, because the soiled wash water and the fresh rinse water were both circulated through the same pumps, strainers and piping, frequently resulting in soil carryover from the wash solution to the rinse water and redepositing soil specks on the foodware. While such foodware items may be completely sanitized according to N.S.F. standards and test methods, their apparent lack of cleanliness often gives restaurant customers the impression that the items are unsanitary. The consuming public frequently associates soil on ware with lack of sanitation.

Thus, although chemical sanitizing warewashers have achieved a niche in the marketplace, the drying problem has been and continues to be a concern. Obviously, drying of the type used in domestic warewashers (where perhaps only one load of dishes may be washed per day) is not at all acceptable in a commercial warewasher environment, where one load of dishes may have to be washed every minute or minute and a half during a main meal period. Even if such drying were made possible, the energy cost of that drying would most likely defeat the very purpose of low temperature warewashing. Further, since N.S.F. specifies differing minimum water volume usage for the various types and sizes of warewashers in the final rinse period of high temperature machines, and since the machines of most manufacturers already appear to be operating right at, or very near, those minimum water volumes, reduction in hot water volume usage below the N.S.F. standard has not appeared to be a feasible alternative in improvement of high temperature machine efficiency. In order to exhibit the N.S.F. seal on the unit, the N.S.F. water volume minimum has seemingly been an untouchable standard, and it thus appears that no one has searched for a way to modify it. Instead, the industry seems to have directed innovative efforts in other directions.

National Sanitation Foundation Standard No. 3 for Commercial Spray Type Dishwashing Machines, includes:

> Section 6.0.3 Heat Unit Equivalents: Those commercial spray type warewashing machines relying on heat for sanitization shall, when installed and operated in accordance with the manufacturer's instructions, produce at least 3600 heat unit equivalents when evaluated in accordance with Appendix A "Heat Sanitization."
>
> Appendix A States:
>
> HEAT SANITIZATION: NSF will use as a guide, Methods of Measuring Heat Unit Equivalents, by J. L. Brown. This document is available from NSF, NSF Building, Ann Arbor, Mich. 48105

A general definition of Heat Unit Eguivalent (HUE) is the amount of heat applied to a foodware surface during exposure to heat within a warewasher, and this unit of heat relates to the degree of bacterial destruction achieved. In actuality, the cumulative heat factor adopted by N.S.F. includes a comfortable safety margin. High temperature commercial warewashers have been required to produce a measurable cumulative heat factor of 3600 HUE for a complete wash and rinse cycle of the dish machine. HUE value is determined by first measuring the Fahrenheit temperature of a dish surface at each single second of time. For each second at 143° F., or above, a different HUE value is obtained. The HUE value is logarithmically related to arithmetic increase in foodware surface temperature. For example, at 143° F. (61.66° C.), the HUE value is 1.0, at 153° F. (67.22° C.) HUE value is 14.3, and at 163° F. (72.77° C.), the HUE value is 203.9. The cumulative heat factor is arrived at by adding all the temperatures for each second of a complete cycle, start to finish. N.S.F., in specifying a given minimum volume of water at a minimum wash temperature of 150° F. for stationary rack machines and 160° F. for conveyor machines for a given minimum time period, and then doing likewise for rinsing with a minimum 180° F. water, has in essence said that a cumulative heat factor or level of 3600 HUE is achieved when those minimums are met.

SUMMARY OF THE INVENTION

The present invention accepts the basic cumulative heat factor requirement of 3600 HUE for sanitization, but not the main basic minimum requirement. These are, for a stationary rack machine a specific volume of 0.43 gallons (1.6 liters) or rinse water at 180° F. (82.22°) for each 100 square inches (645 sq. cm.) of rack area, and for a typical conveyor machine a volume of 0.414 gallons (1.57 liters) at the 180° F. temperature for each 100 square inches (645 sq. cm.) of rack area. While it is known in high temperature machines, both domestic and commercial, that heating of water is the primary contributor to high energy cost, what has not been known was that the HUE requirement of N.S.F. could be met with a reduced volume of rinse water, provided some other means of achieving the cumulative HUE minimum were found.

That is what is accomplished with the invention. It has been found that a machine can use less of the 180° F. rinse water (approximately 33% less in the preferred embodiment in one type of warewasher), and still obtain the HUE requirement by maintaining the dishes within an essentially enclosed chamber for a given relatively short period of time after completion of rinsing. At the shutoff point of the rinse water, less than half of the required HUE may have been achieved, and the rest are accumulated during the immediately following static (dwell) hot humid period.

For example, in a single tank warewasher of the stationary rack type which has a hood or door, this is achieved either by providing a cycle light which indicates the warewasher is still functioning to accumulate additional HUE after rinsing has discontinued, or alternatively by latching the door or hood until the required humid static period has been completed.

In a conveyor type machine significant energy savings also are available by carefully controlling the flow rate and timing of the final fresh hot water rinse. In such machines the fresh hot water flow is controlled by a solenoid operated valve (or equivalent) actuated in response to a rack located at the final rinse station. In accordance with the invention the rack of rinsed ware is kept within an enclosure at the discharge end of the machine for a time sufficient to achieve the HUE requirement, and the total flow of hot water from the rinse spray can be decreased in order to conserve energy.

The present invention thus achieves significant energy savings at relatively nominal cost in equipment, at little or no sacrifice in machine productivity time and in a manner which, although simple, is quite unexpected, being contrary to accepted past practices of the commercial warewasher industry for high temperature warewashers according to N.S.F. standards.

Although the hot water rinse volume is reduced below the presently required minimum, tests conducted by N.S.F. on a stationary rack machine incorporating the invention have resulted in the machine being approved for listing by N.S.F. and labeling with their label. The 3600 HUE requirement has been met, although the volume of 180° F. water used per complete cycle has been reduced approximately one third, without sacrificing cleanability or sanitization. The lower water volume also benefits the user in other cost-saving ways. Less water usage means less wash water dilution, and less dilution saves on consumption and cost of both detergent and rinse agent. Compared strictly to chemical sanitizing low temperature machines, it also saves by eliminating sodium hypochlorite and the capital cost of its dispensing equipment. Furthermore, the aforementioned dishware drying problem associated with low temperature machines is avoided.

The object of the invention, therefore, is to provide a novel method of operating a warewasher, particularly of the high capacity rack type, in which the final rinse period includes spraying the rack of foodware items with fresh water at a temperature of at least 180° F. (82.22° C.) in sufficient amount and for sufficient time to remove residual soil and to heat the foodware surfaces to at least 150° F. (65.5° C.) for stationary rack machines and 160° F. (71.11° C.) for conveyor machines followed by a dwell period in which the foodware is maintained in a closed humid atmosphere to prolong the time during which the foodware surfaces remain above bacteria killing temperature; to provide such a method which thereby reduces the total heat required to sanitize foodware items in accordance with accepted standards; and to provide a warewashing machine capable of performing such method.

DESCRIPTION OF THE PREFERRED EMBODIMENTS

Figure 1:
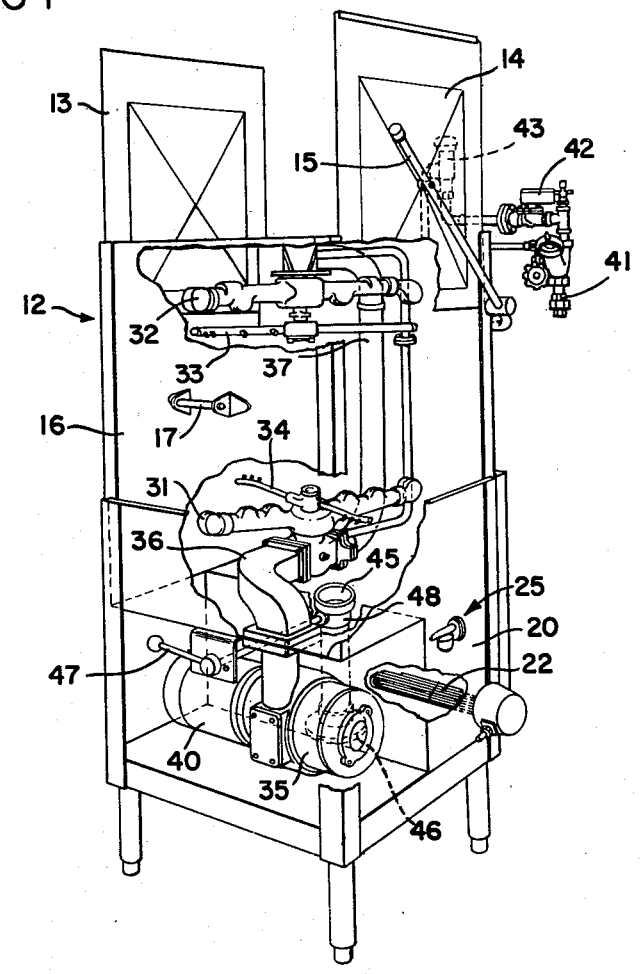
FIG. 1 is a perspective view, partially broken away, showing a warewasher incorporating the invention.

Referring now to the drawings, and particularly to FIG. 1, a semiautomatic, rack type commercial warewasher 10 is shown which includes a wash chamber 12, entry to which is provided by doors 13 and 14 movable from a lower position to an upper position by means of a wrap around handle 15. A third door at the front of the warewasher serves as an inspection door 16 and may be lifted by means of handle 17.

A wash tank 20 located in a lower part of the warewasher is heated by means of an electric immersion heater 22. The water level is sensed by means of a float and switch assembly 25, and the water temperature is sensed by means of a thermistor (not shown) built into the float and switch assembly. The wash tank 20 may also be heated by means of a gas fired burner located beneath and wash tank or by steam.

Within the washing chamber 12 are revolving lower and upper wash arms 31 and 32, and upper and lower rotary rinse spray arms 33 and 34. The washing solution contained in the wash tank 20 is pumped to the wash arms 31 and 32 through manifolds 36 and 37 by means of a self-draining pump 35, driven by an electric motor 40. Rinse water is supplied through a connection 41 to the rinse spray arms 33 and 34 under the control of a rinse solenoid valve 42. A vacuum breaker 43 is provided on the downstream side of the rinse valve.

Excess water in the wash tank is removed by means of an overflow drain tube 45, the upper part of which serves to limit the level of water in the wash tank. The lower part of the drain tube 45 fits within a drain assembly 46 at the lower part of the tank and is closed when the drain tube is in its lower-most position. The drain tube 45 may be raised by means of handle 47 which rotates a cam 48 to lift the drain tube 45.

A door interlock may be provided to lock the doors 13 and 14 in the lowermost position during operation of the warewasher. This interlock includes a solenoid (not shown) controlling a pin which moves outwardly to prevent the upward movement of both doors. A safety switch (not shown) is optionally included to terminate the warewasher operation if the doors are opened. This switch may also be used to initiate the warewasher cycle. The pump motor 40, the solenoid valve 42, the interlock solenoid (where used), the heater 22, the switch of the float assembly, and the temperature sensing thermistor are all connected to a suitable timer control. A suitable such control is disclosed in detail in U.S. Pat. No. 3,911,943.

Figure 2:
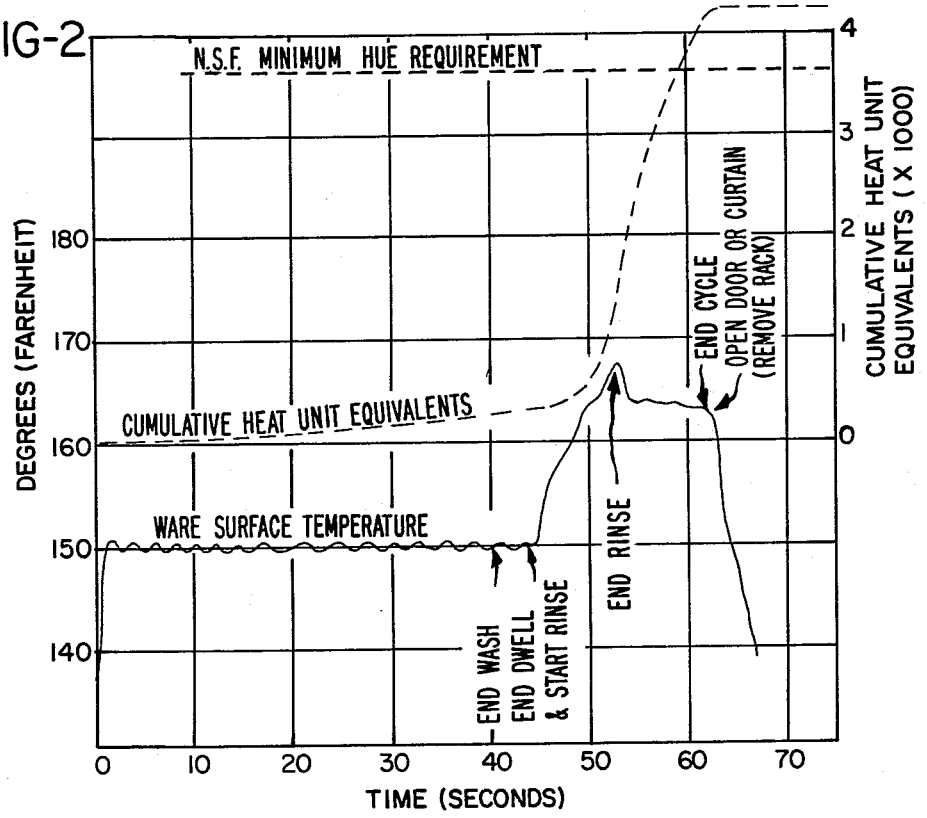
FIG. 2 is a graph illustrating typical time/HUE/surface temperature relationships for a single tank, stationary rack machine.

FIG. 2 is a diagram which illustrates a typical operating cycle for cleansing one rack of soiled ware in a machine such as shown in FIG. 1. The wash period (40 seconds) of the cycle is the time during which the main pump is energized, and liquid from the tank is sprayed through the upper and lower arms 31 and 32. It should be noted that the ware surface temperature quickly rises to about 150° F. (65.5° C.). N.S.F. standards for this type of machine call for a wash liquid temperature of at least 150° F. At the end of the wash period there is a short (4 seconds) dwell time, and then the rinse solenoid 42 is energized, opening the associated valve and allowing fresh hot water to enter the connection 41 and, through the spray arms 33 and 34, spray over the ware in the rack. This operation performs two functions. The ware is rinsed of any remaining small particles of soil, and any remaining cleaning solution is flushed from the surfaces of the ware. In addition, the fresh hot water, which is at a temperature of at least 180° F., raises the surface temperature of the ware. As previously pointed out, the time that the rinse valve remains open is reduced (to 9 seconds), as compared to prior art machines, being sufficient to heat the surfaces of the ware to a temperature of at least 160° F. The solenoid is then deenergized and flow of hot rinse water stops, but the rack of ware remains in the machine for an additional 9 seconds with the chamber closed. This can be accomplished either by a warning, such as a light operated by the timer, which warns the operator not to open the doors until the light extinguishes, or by timer control of the interlock solenoid which actually latches the doors against opening until the end of the dwell period.

The curves plotted on FIG. 2 illustrate the temperature at the surface of the ware in a typical operation of a single tank stationary rack machine, as well as the cumulative HUE against time in relationships which exist in typical machines in accordance with the invention. The cycle times are understood to be typical, but not limiting.

Figure 3:
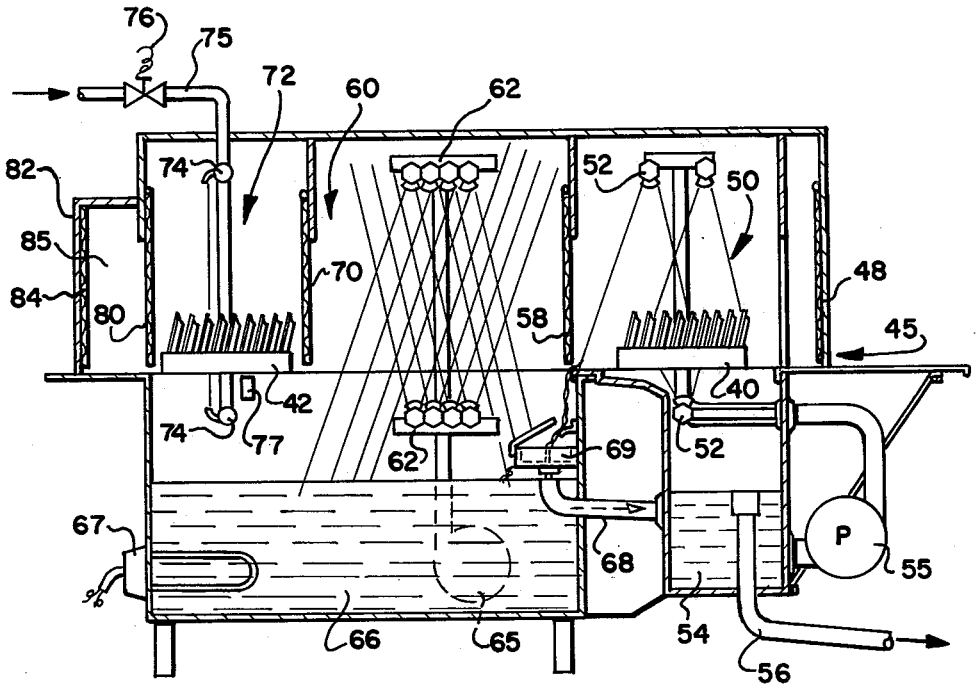
FIG. 3 is a vertical cross-sectional view of a conveyor type warewasher incorporating the invention.

FIG. 3 illustrates a model of rack-type conveyor warewashing machine to which the present invention is also applicable. In such machines racks of soiled foodware, shown generally at 40 and 42, are moved through the machine by a suitable conveyor mechanism which is shown schematically by the arrow 45. Either continuously or intermittently moving conveyor mechanisms are used depending upon the style, model and size of the machine. The racks of soiled ware enter the machine through a flexible curtain 48 into a scrapping chamber 50, where sprays of liquid from nozzles 52 above and below the racks function to flush heavier soil from the foodware. The liquid for this purpose comes from a tank 54 via a pump 55, and the level in this tank is maintained by a stand pipe 56 which overflows to drain.

The racks then proceed through the next curtain 58 into the main wash chamber 60, where the food ware is subjected to sprays of cleansing liquid from upper and lower nozzles 62, these being supplied by a pump 65 which draws from the main tank 66. A heater, shown schematically as an electrical immersion heater 67, and provided with suitable thermostatic controls, maintains the temperature of the cleansing liquid at a suitable temperature, as in the order of 160° F. Not shown, but typically included, are a device for adding a cleansing detergent to the liquid in the tnak 66, and controls for this device which maintain the concentration of detergent within desired limits. Overflow from tank 66 exits via pipe 68 into the scrapping liquid tank 54. Above the overflow 68 there is a small catch pan 69 which may be used to direct any splash of scrapping liquid that passes under the curtain 58 down into the overflow 68 and back to tank 54. During normal operation of the machine, the pumps 55 and 65 are continuously driven, usually by separate motors, once the machine is started and until the period of use of the machine is completed.

The racks of cleansed ware exit the main chamber 60 through a curtain 70 into the final rinse chamber 72, which is provided with upper and lower spray heads 74 that are supplied with a flow of fresh hot water via pipe 75, and under the control of a solenoid operated valve 76. This water is, in accordance with NSF and similar standards, supplied at a temperature of at least 180° F. A rack detector 77 is actuated when a rack of ware is positioned in the chamber 72, and through suitable electrical controls the detector controls energizes the solenoid valve 76 to open and admit the hot rinse water to the spray heads 74. The fresh water drains from the ware into tank 66.

The rinsed racks of food ware exit chamber 72 through curtain 80 and, in this embodiment of the invention, enter and pass through a chamber defined by a hood 82 with side walls and an exit curtain 84. The length of the hood 82 is sufficient to define a holding chamber 85, within which the racks of hot sanitized ware are maintained in a substantially enclosed humid environment. In one successful embodiment the length of hood 82 is 20 inches (50.8 cm.). This allows the buildup of HUE in essentially the same manner as previously described in connection with stationary rack machines. Here, the dwell period is the time during which a rack of rinsed ware traverses chamber 85. It should be noted that the intermediate curtain 80 is not essential, but it is part of the preferred embodiment.

In the conveyor type machines, the advantage of the invention results from a reduction in the quantity of fresh hot water used for each final rinse operation, while still obtaining the necessary total HUE at the surface of the ware in order to sanitize this ware in accordance with accepted standards. N.S.F. standards for a typical such machine require a cleaning solution temperature of at least 160° F. (71.1° C.), 10° F. higher than the stationary rack machine. This of course brings the ware to the final rinse position with a slightly higher surface temperature. Typical prior conveyor machines have used in the order of 2.3 gallons (8.71 liters) of 180° F. final rinse water for each final rinse spraying. With the present invention this quantity can be reduced to in the order of 1.4 gallons (5.3 liters) rinse per standard rack.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention which is defined in the appended claims.

What is claimed is:

1. In a commercial dishwasher, a complete warewasher cycle for (1) washing food soil from successive racks of ware such as dishes and utensils with a cleaning solution of water and detergent, (2) rinsing the ware with fresh water, and (3) effectively sanitizing the ware to a cumulative heat factor level over the complete cycle to meet accepted heat sanitization practices, comprising the steps of:

(a) loading soiled ware into the racks and placing a loaded rack in a substantially enclosed wash chamber of a warewashing machine, (b) recirculating a supply of cleaning solution in said chamber under pressure through nozzles which direct the solution over the ware in sufficient volume and at a predetermined washing temperature with sufficient velocity and for a predetermined washing time period effective to strip the soil from and thereby wash the ware, (c) maintaining said cleaning solution supply at a minimum washing temperature during the washing time period, (d) upon completion of the washing time period, providing a short dwell period during which soiled solution can drain from the ware, then (e) sanitizing the ware by sequentially:

(i) rinsing the ware for a predetermined rinse period with fresh rinse water heated to a minimum sanitizing temperature greater than said washing temperature and delivered through rinse nozzles dedicated solely to said rinse water and directed toward the ware, said rinse water being delivered in a volume sufficient to rinse loose food soil and remaining cleaning solution from the ware and achieve a substantial reduction in water volume in order to conserve energy, and said rinse period being of a duration whereby the surfaces of the ware rise from the temperature achieved during washing to a higher temperature to apply heat unit equivalents per second of time to said ware between an approximate minimum of 40% but less than 100% of the cumulative heat factor level required by accepted sanitization practices to achieve effective sanitization, and, (ii) upon completion of the rinse period and while the ware is still exposed to the accumulated rinse water and cleaning solution, maintaining the ware within a substantially enclosed chamber for a time period, in addition to any inherent time delay of a cycle controller, sufficient to allow the heated humid atmosphere within said chamber achieved without further addition of heat except from the heated fresh rinse water to apply to the ware surfaces additional heat unit equivalents, which, coupled with those applied during prior washing and rinsing, raises the cumulative heat factor for the complete warewasher cycle above the minimum level required to effectively sanitize the ware, and then (f) removing the clean, sanitized ware from the machine.

2. The warewasher cycle of claim 1, wherein said minimum washing temperature is 150° F. and said minimum rinsing temperature is 180° F.

3. The warewasher cycle of claim 1 wherein the rinse period duration and the minimum washing and rinsing temperatures are such as to achieve a minimum ware surface temperature of approximately 165° F. by the end of the rinse period.

4. In a commercial rack-type high capacity warewashing machine designed to cleanse and sanitize foodware in a cycle time of the order of one minute and to accomplish sanitizing by heating the foodware with fresh hot water sufficiently to kill residual bacteria thereon, wherein racks of ware are first sprayed with a cleaning solution to strip the soil from and wash the soiled ware and then the racks are rinsed with fresh hot water, the improved method of operation including a final rinse period in which fresh water at a temperature of at least 180° F. is sprayed over the foodware to remove residual soil and to heat the foodware surfaces to at least 160° F., and a dwell period, in addition to any inherent time delay of a cycle controller, following said rinse period and while the ware is still exposed to the accumulated rinse water and cleaning solution in which the wet heated foodware is maintained in a closed humid atmosphere without further addition of heat from a source other than the fresh hot water to prolong the time during which the foodware surfaces remain above bacteria killing temperature and to achieve a substantial reduction in rinse water volume in order to conserve energy.

* * * * *